US008327974B1

(12) United States Patent
Smith, Jr. et al.

(10) Patent No.: US 8,327,974 B1
(45) Date of Patent: Dec. 11, 2012

(54) SOUND ENHANCING APPARATUS

(76) Inventors: Harold N. Smith, Jr., Spring, TX (US); Harold N. Smith, III, Spring, TX (US)

( * ) Notice: Subject to any disclaimer, the term of this patent is extended or adjusted under 35 U.S.C. 154(b) by 0 days.

(21) Appl. No.: 13/136,659

(22) Filed: Aug. 8, 2011

(51) Int. Cl.
*G10K 11/00* (2006.01)

(52) U.S. Cl. ..... 181/175; 181/177; 181/156; 181/152; 181/199; D14/214

(58) Field of Classification Search ..... 181/175, 181/177, 156, 152, 199; D14/214
See application file for complete search history.

(56) References Cited

U.S. PATENT DOCUMENTS 1,407,574 A * 2/1922 Price ..... 181/177
5,327,985 A * 7/1994 Porzilli ..... 181/177
6,012,542 A * 1/2000 Accordino ..... 181/199
6,349,792 B1 * 2/2002 Smith et al. ..... 181/156
6,520,282 B1 * 2/2003 Hadzic et al. ..... 181/199
7,296,653 B1 * 11/2007 Smith et al. ..... 181/155
7,878,296 B2 * 2/2011 Lee ..... 181/148
D654,906 S * 2/2012 Warden et al. ..... D14/214

* cited by examiner

*Primary Examiner* — Forrest M Phillips
(74) *Attorney, Agent, or Firm* — William W. Haefliger

(57) ABSTRACT

A sound enhancer for use with a speaker assembly, comprising a sound manifold forming an enclosure having upper and lower hollow interior portions, the enclosure defining an interior zone within an upper interior portion and having an inlet that faces angularly forwardly, and upwardly, a speaker assembly facing rearwardly through an inlet and into an interior zone to transmit sound rearwardly within the upper interior portion, the enclosure having a back panel to reflect sound transmission downwardly toward and into the enclosure lower interior portion, the lower interior portion having a frontward facing outlet from which sound is transmitted forwardly below the level of the speaker assembly.

7 Claims, 4 Drawing Sheets

SOUND ENHANCING APPARATUS

BACKGROUND OF THE INVENTION

The present invention relates generally to the field of loud speaker equipment and more particularly to a sound enhancing speaker cabinet for removable speaker assemblies.

Portable speaker equipment, particularly amplifiers for electronic amplification of musical instruments, have been produced with associated acoustical speakers. Of particular concern are guitar amplifiers used to amplify electric guitar music. These amplifiers or speaker assemblies are often two to three feet high and are positioned on the ground or on the stage behind a musician. The front of the speaker enclosure generally has an opening through which the speaker transmits or directs the primary portion of the acoustic energy and a substantially open rear wall through which a secondary portion of the acoustical energy is directed rearwardly. Normally the speaker assembly directs the sound along a horizontal axis toward or pointed at the audience; while the secondary portion of the acoustical energy is directed away from the audience with this energy being essentially lost or wasted.

A frequent problem for the performing musician is that it is difficult to hear oneself playing with the typical loud speaker equipment. Since the speaker assemblies are generally two to three feet tall and are placed on the ground level behind the musician, the primary portion of the sound is directed horizontally about the knee-level of the musician. This results in too little sound reaching the height of the musician's ears for monitoring.

There is need for improved apparatus overcoming such problems and deficiencies of prior equipment, and in particular by the improved compact apparatus as disclosed herein.

SUMMARY OF THE INVENTION

It is a major object of the invention to provide highly compact and improved sound enhancing apparatus and equipment, and which typically has:

a) a sound manifold forming an enclosure having upper and lower hollow interior portions, the enclosure defining an interior zone within said upper interior portion and having an inlet that faces angularly forwardly, and upwardly, b) a speaker assembly facing rearwardly through said inlet and into said interior zone to transmit sound both forwardly and rearwardly within said upper interior portion, c) said enclosure having a back panel to reflect rearward sound transmission downwardly toward and into the enclosure lower interior portion, d) the lower interior portion having a frontward facing outlet from which sound is transmitted with megaphone effect forwardly below the level of the speaker assembly.

It is another object to provide such apparatus having an interior panel that slants downwardly and rearwardly between said upper and lower hollow interior portions, in supporting relation with the received speaker assembly.

A further object is to provide such apparatus having a front panel structure slanted upwardly and rearwardly, said inlet formed by said front panel structure. Typically, the front panel structure includes two front panels between which said inlet is centrally formed, said upper interior zone being in alignment registrable with said inlet, whereby the sideward extents of said upper interior portion remain openly hollow at opposite sides of said speaker assembly.

An added object is to provide apparatus wherein the referenced back panel extends rearwardly of said hollow sideward extents of said enclosure upper interior portion, whereby said hollow sideward extents of said enclosure upper interior portion receive sound reflection from said back panel, to resonate with said sound transmission.

Yet another object includes apparatus as referred to wherein the hollow lower interior portion has megaphone configuration, diverging forwardly toward said outlet.

An additional object is to provide upright support panels in the hollow enclosure lower interior portion to separate sound transmittance forwardly into three parallel megaphone channels.

As will be seen two of said channels are in sound receiving communication, respectively, with said hollow sideward extents of said enclosure upper interior portion.

A yet further object is obviate need for a separate cabinet unit as indicated at A in U.S. Pat. No. 6,349,792, incorporated herein by reference.

These and other objects and advantages of the invention, as well as the details of an illustrative embodiment, will be more fully understood from the following specification and drawings, in which:

DRAWING DESCRIPTION

Figure 2:
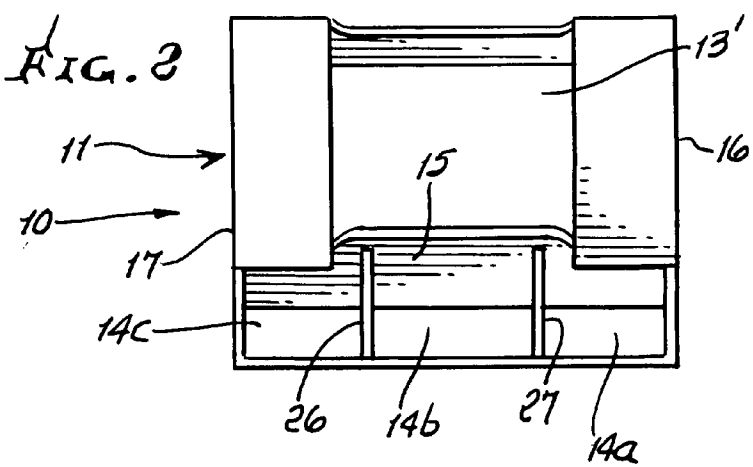
FIG. 2 is a front view of the FIG. 1 enclosure.
Figure 3:
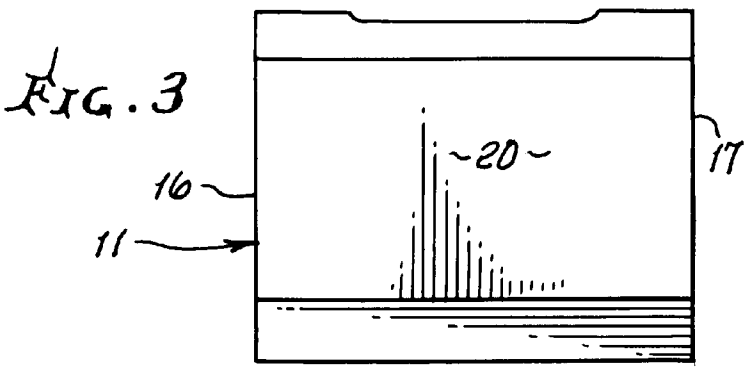
FIG. 3 is a rear view of the enclosure.
Figure 1:
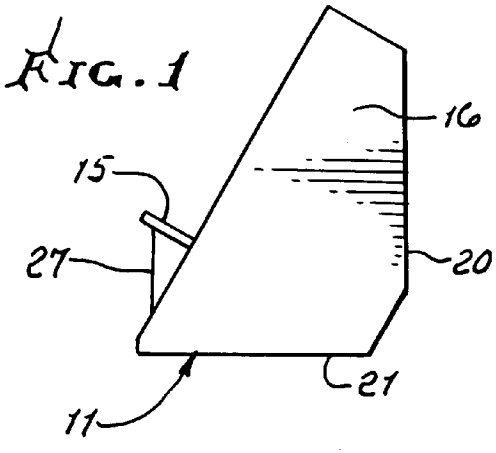
FIG. 1 is a side view of a compact, sound enhancing enclosure.
Figure 4:
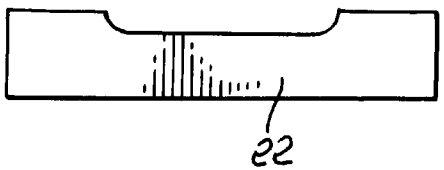
FIG. 4 is a view of the enclosure top panel.
Figure 5:
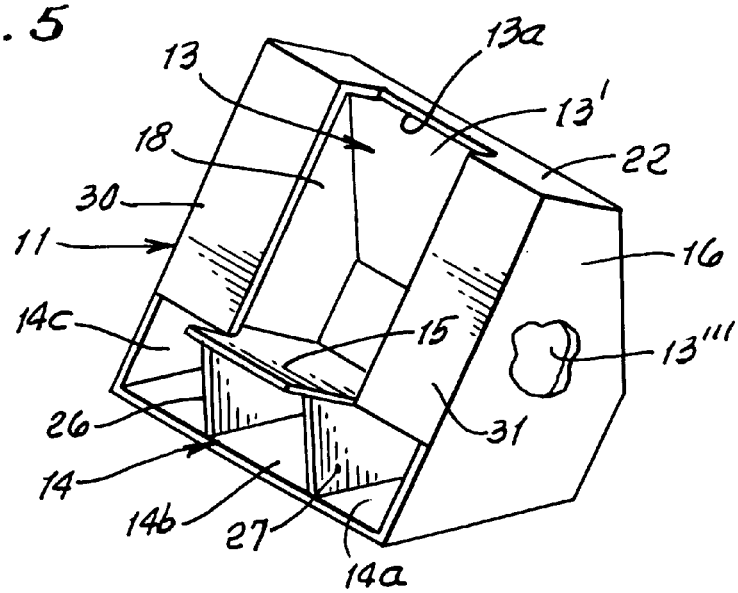
FIG. 5 is an isometric view of the enclosure, showing front and right sides.
Figure 5:
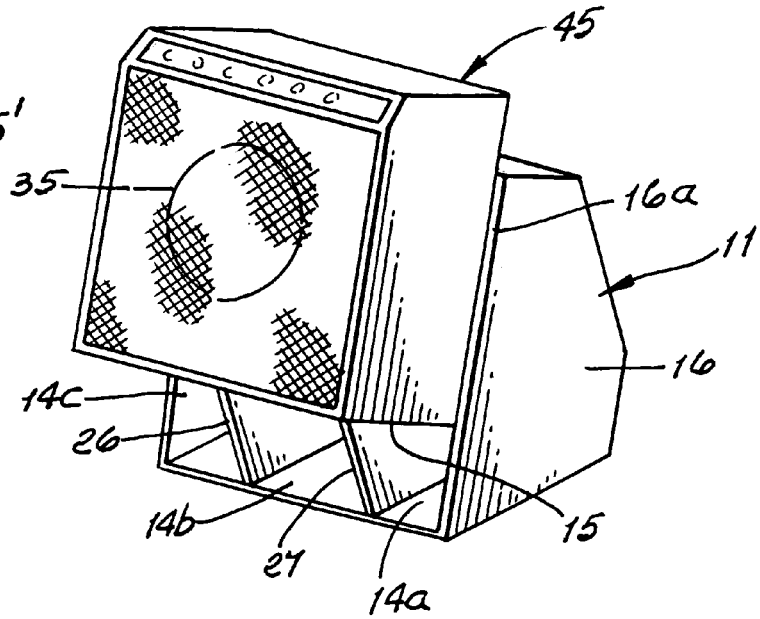
Figure 5A:
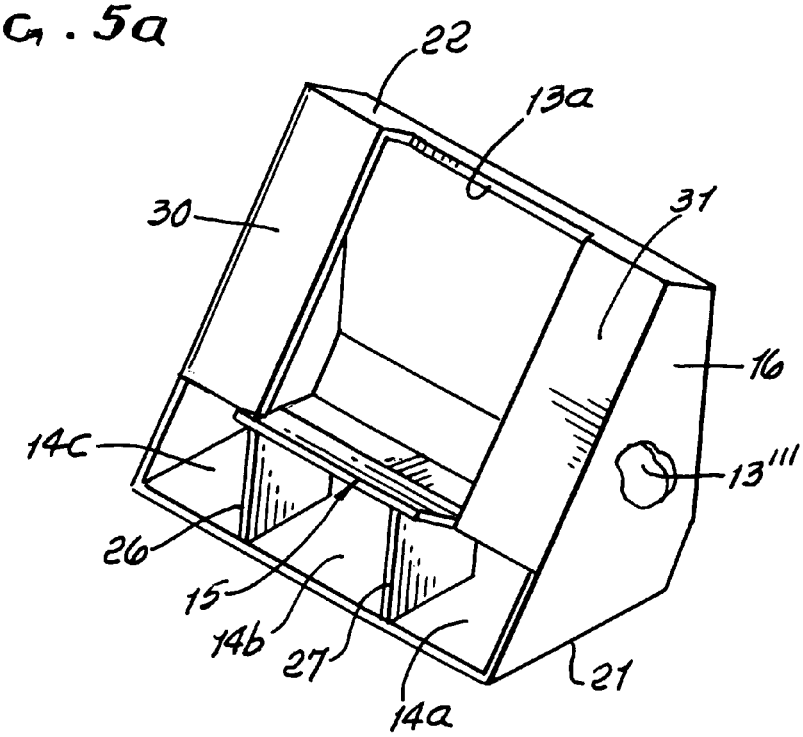
Figure 6:
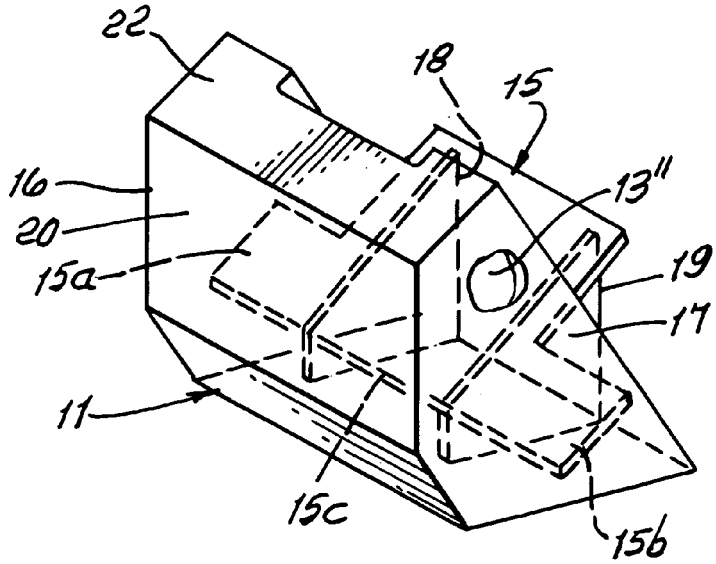
Figure 7:
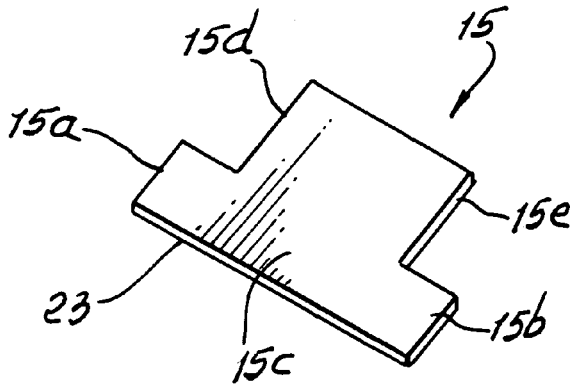
Figure 8:
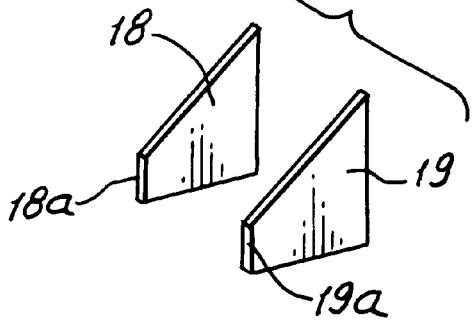

FIG. 5' is like FIG. 5, but with speaker cabinet cradle supported;

FIG. 5*a* is an enlarged view;

FIG. 6 is an isometric view of the enclosure, showing is left and rear side, and top;

FIG. 7 shows a T-shaped interior panel;

FIG. 8 shows upright panels that interfit the T-shaped panel; and

Figure 9:
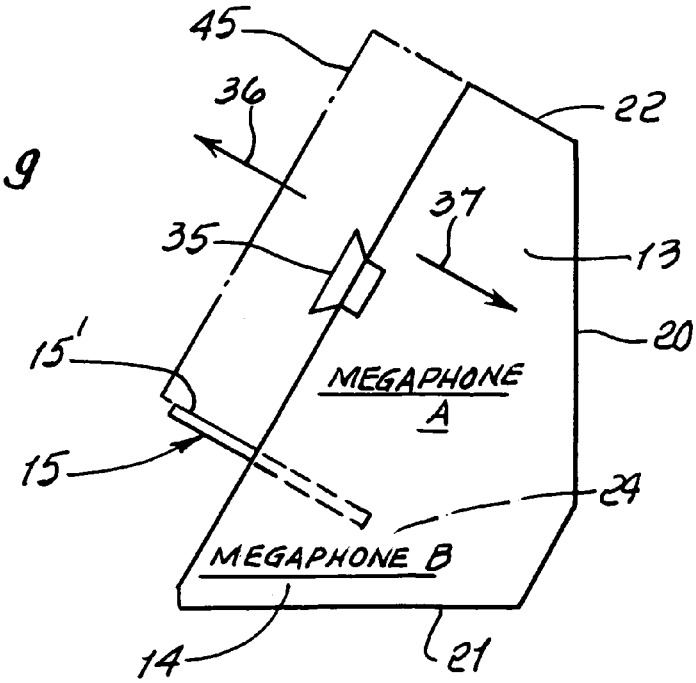

FIG. 9 is a side view showing compact, dual megaphone aspects.

DETAILED DESCRIPTION

The preferred sound enhancing assembly 10 includes an enclosure 11 having hollow upper and lower sound enhancing interior portions or chambers 13 and 14. The enclosure defines a forwardly opening upper interior zone 13' within the upper interior portion 13, and having an inlet 13*a* that faces angularly forwardly and upwardly. An interior panel 15 is at the bottom of zone 13', and is angled forwardly, and upwardly, as shown. Panel 15 is preferably T-shaped, and has wings 15*a* and 15*b* that extend sidewardly from the central part 15*c* of that panel, and toward the side walls 16 and 17 of the enclosure. Upright panels 18 and 19 sidewardly interfit the edges 15*d* and 15*e* of T-shaped panel 15, to sidewardly enclose central zone 13'. The enclosure has a back wall 20 fitting edges 18*a* and 19*a* of the upright panels 18 and 19 as well as edges of the side walls 16 and 17, and a bottom wall 21 fitting lower edges of 16, 17 and 20. Enclosure top wall 22 fits upper edges of 16, 17 and 20 and is much shorter in front to rear dimensions than bottom wall 21. Wings 15*a* and 15*b* extend sidewardly to the side walls 16 and 17; however, the rearward edge 23 of the T-shaped panel 15 is interiorly spaced at 24 from the back wall 20, to allow sound travel from upper zone 13' downwardly to lower interior zone 14. That sound is reflected forwardly from the rear wall to exit at outlets 14*a*, 14*b* and 14*c*. Central outlet 14*b* is below central zone 13', and is formed between upright panels 26 and 27; left side outlet 14*a* is formed between panel 27 and the left side wall 16; and right side outlet 14*c* is formed between panel 26 and side wall 17. Megaphone sound enhancement is provided by the forwardly expanding shapes of the lower interior sub-zones formed rearwardly of the three outlets 14*a*, 14*b* and 14*c*.

Front panel structure includes two front panels 30 and 31 between which the inlet 13*a* is formed, to removably receive the acoustic device sound as from speaker 35 that transmits sound forwardly and rearwardly as indicated by arrows 36 and 37 in FIG. 9. The upper interior of central zone 13' is in aligned registration with inlet 13*a*, whereby the sideward extents 13" and 13'" of the enclosure upper interior portion remain hollow at opposite sides of the speaker 35. Those extents 13" and 13'" receive sound reflection from the back panel to resonate with sound transmission. Also, those extents 13" and 13'" are in sound resonating communication with the two lower sound transmitting zones that terminate at outlets 14*a* and 14*c*.

In FIGS. 5' and 9, a speaker cabinet 45 seats on inclined panel 15 formed projection 15' and engages the upward and rearward slanted edges 16*a* and 17*a* of side panels 16 and 17. Thus cabinet 45 is cradle supported. This accommodates to the dual megaphone sound channels A and B, seen in FIG. 9.

U.S. Pat. No. 7,296,653 is also incorporated herein by reference.

What is claimed is:

1. A sound enhancer for use with a speaker assembly, comprising:

a) a sound manifold forming an enclosure having upper and lower hollow interior portions, the enclosure defining an interior zone within said upper interior portion and having an inlet that faces angularly forwardly, and upwardly, b) a speaker assembly facing rearwardly through said inlet and into said interior zone to transmit sound rearwardly within said upper interior portion, c) said enclosure having a back panel to reflect said sound transmission downwardly toward and into said enclosure lower interior portion, d) said lower interior portion having a frontward facing outlet from which sound is transmitted forwardly below the level of said speaker assembly e) said hollow lower interior portion has megaphone configuration, diverging forwardly toward said outlet, f) there being two upright and parallel support panels located within said enclosed hollow lower interior portion to separate sound transmittance forwardly into three parallel megaphone channels, g) there being an interior cover panel covering the middle one of said channels and extending over said parallel support panels said interior cover panel projecting forwardly and upwardly relative to the two upright parallel panels to removably and cradably support the speaker assembly, only the two interior support panels supporting that assembly, wherein said support panel is T-shaped for separating said upper and lower interior portions, and the T-shaped panel having a stem projecting forwardly from the enclosure in supporting relation with the speaker apparatus from which sound is transmitted forwardly and also rearwardly into said upper interior portion that has dual megaphone relation with said lower interior portions.

2. The combination of claim 1 wherein said interior panel slants downwardly and rearwardly between said upper and lower hollow interior portions, in cradle supporting relation with said received speaker assembly.

3. The combination of claim 1 wherein the enclosure has front panel structure slanted upwardly and rearwardly, said inlet formed by said front panel structure.

4. The combination of claim 3 wherein said front panel structure includes two front panels between which said inlet is centrally formed, said upper interior zone being in alignment registration with said inlet, whereby the sideward extents of said upper interior portion remain openly hollow at opposite sides of said speaker assembly.

5. The combination of claim 4 wherein said back panel extends rearwardly of said hollow sideward extents of said enclosure upper interior portion, whereby said hollow sideward extents of said enclosure upper interior portion receive sound reflection from said back panel, to resonate with said sound transmission.

6. The combination of claim 5 wherein said hollow lower interior portion has megaphone configuration, diverging forwardly and upwardly toward said outlet.

7. The combination of claim 1 wherein two of said megaphone channels are in sound receiving communication, respectively, with said hollow sideward extents of said enclosure upper interior portion.

* * * * *